US011795619B2

(12) United States Patent
Wei et al.

(10) Patent No.: US 11,795,619 B2
(45) Date of Patent: Oct. 24, 2023

(54) TAILORED HEMICELLULOSE IN NON-WOOD FIBERS FOR TISSUE PRODUCTS

(71) Applicant: Kimberly-Clark Worldwide, Inc., Neenah, WI (US)

(72) Inventors: Ning Wei, Roswell, GA (US); Thomas G. Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/590,481

(22) Filed: Feb. 1, 2022

(65) Prior Publication Data

US 2022/0154400 A1 May 19, 2022

Related U.S. Application Data

(63) Continuation of application No. 16/605,332, filed as application No. PCT/US2018/029112 on Apr. 24, 2018, now abandoned.

(60) Provisional application No. 62/491,569, filed on Apr. 28, 2017.

(51) Int. Cl.
*D21H 11/12* (2006.01)
*D21H 27/00* (2006.01)
*D21H 27/38* (2006.01)

(52) U.S. Cl.
CPC ..... *D21H 11/12* (2013.01); *D21H 27/002* (2013.01); *D21H 27/38* (2013.01)

(58) Field of Classification Search
CPC ..... D21H 27/30; D21H 11/20; D21H 11/12; D21H 27/002; D21H 27/005; D21H 27/007; D21H 27/38; D21H 17/24; D21C 5/005; C12N 9/248
See application file for complete search history.

(56) References Cited

U.S. PATENT DOCUMENTS 3,932,209 A * 1/1976 Chatterjee ..... A61L 15/28 162/157.6
4,634,499 A 1/1987 Ampulski
4,940,513 A 7/1990 Spendel
5,582,681 A 12/1996 Back et al.
5,620,565 A 4/1997 Lazorisak et al.
6,194,638 B1 * 2/2001 Dhugga ..... C12N 9/1051 435/320.1
8,182,650 B2 5/2012 Tan et al.
8,313,613 B2 11/2012 Matsumura et al.
8,877,678 B2 11/2014 Koyama et al.
9,074,324 B2 * 7/2015 Shannon ..... D21H 27/38
9,487,549 B2 * 11/2016 Fackler ..... C07G 1/00
10,077,283 B2 * 9/2018 Dybov ..... C07G 1/00
10,458,067 B2 * 10/2019 Zawadzki ..... D21F 11/006
2004/0129395 A1 * 7/2004 Rehders ..... D21H 27/007 162/111
2007/0000627 A1 1/2007 Tan et al.
2011/0287275 A1 * 11/2011 Tan ..... A61F 13/15 428/532
2012/0247696 A1 10/2012 Bogren et al.
2013/0066291 A1 * 3/2013 Tan ..... A01N 59/00 604/378
2013/0146239 A1 6/2013 Tausche et al.
2013/0217868 A1 8/2013 Fackler et al.
2014/0048223 A1 2/2014 Li et al.
2015/0007953 A1 * 1/2015 Tan ..... A01N 59/00 162/78
2015/0184338 A1 7/2015 Luo et al.
2015/0184343 A1 7/2015 Li et al.
2015/0259709 A1 9/2015 Retsina et al.
2016/0138224 A1 * 5/2016 Shannon ..... D21H 11/04 162/129
2016/0326697 A1 11/2016 Retsina et al.
2017/0073365 A1 * 3/2017 Fackler ..... C07G 1/00
2017/0172152 A1 * 6/2017 Tan ..... D21H 11/04
2018/0334659 A1 * 11/2018 Gray ..... C12P 19/02

(Continued)

FOREIGN PATENT DOCUMENTS

EP 3072117 B1 * 9/2018 ..... C07G 1/00
GB 2534589 A 8/2016
GB 2576122 A * 2/2020 ..... D21H 27/00
GB 2576122 A 2/2020
WO 07118264 A2 10/2007
WO 2008044860 A1 4/2008
WO WO-2008044860 A1 * 4/2008 ..... D21C 5/00
WO 2016079045 A1 5/2016

(Continued)

OTHER PUBLICATIONS

Azeez et al., in "Bamboo, Its Chemical Modification and Products," Intech Open, pp. 26-48 (Year: 1918).

(Continued)

*Primary Examiner* — Jose A Fortuna
(74) *Attorney, Agent, or Firm* — Kimberly-Clark Worldwide, Inc.

(57) ABSTRACT

A tissue sheet includes softwood fibers and treated non-wood fibers from plants in the Poaceae family, wherein the treated non-wood fibers have less than 15 percent hemicellulose. Also, a tissue sheet consists essentially of softwood fibers and treated non-wood fibers, wherein the treated non-wood fibers have less than 15 percent hemicellulose. Customizing the tensile index and Canadian standard freeness (CSF) of fibers in a tissue sheet includes treating non-wood fibers by removing a portion of hemicellulose from the non-wood fibers; forming a tissue sheet comprising softwood fibers and the treated non-wood fibers; and adjusting the portion of hemicellulose removed from the non-wood fibers to achieve a desired the tensile index and Canadian standard freeness (CSF) of the treated non-wood fibers.

11 Claims, 2 Drawing Sheets

(56) References Cited

U.S. PATENT DOCUMENTS

| | | | | |
|---|---|---|---|---|
| 2019/0203413 | A1* | 7/2019 | Tan | D21C 9/002 |
| 2019/0226147 | A1* | 7/2019 | Zawadzki | D21F 1/0027 |
| 2020/0325628 | A1* | 10/2020 | Wei | D21H 27/02 |
| 2021/0025112 | A1* | 1/2021 | Taylor | D21H 11/18 |
| 2021/0054572 | A1* | 2/2021 | Zawadzki | D21H 27/002 |
| 2022/0081840 | A1* | 3/2022 | Reeve-Larson | D21H 17/68 |

FOREIGN PATENT DOCUMENTS

| | | | | |
|---|---|---|---|---|
| WO | WO-2016079045 | A1 * | 5/2016 | D21C 9/00 |
| WO | 2018200501 | A1 | 11/2018 | |
| WO | WO-2018200501 | A1 * | 11/2018 | D21H 27/02 |

OTHER PUBLICATIONS

Martin-Sampedro et al., "Integration of a kraft pulping mill into a forest biorefinery: Pre-extraction of hemicellulose by steam explosion versus steam treatment", Bioresource Technology 153 (2014) p. 236-244.

* cited by examiner

TAILORED HEMICELLULOSE IN NON-WOOD FIBERS FOR TISSUE PRODUCTS

RELATED APPLICATIONS

The present application is a continuation application and claims priority to U.S. patent application Ser. No. 16/605,332, filed on Oct. 15, 2019, now abandoned, which is a national-phase entry, under 35 U.S.C. § 371, of PCT Patent Application No. PCT/US18/29112, filed on Apr. 24, 2018, which claims benefit of U.S. Provisional Application No. 62/491,569, filed on Apr. 28, 2017, all of which are incorporated herein by reference.

BACKGROUND

The present disclosure relates to the use of non-wood alternative natural fibers in tissue products. A replacement of the conventional hardwood fiber is achieved by a hybrid fibrous composition that provides sufficient mechanical strength for tissue applications.

Tissue products, such as facial tissues, paper towels, bath tissues, napkins, and other similar products, are designed to include several important properties. For example, the products should have good bulk, a soft feel, and should have good strength and durability. When steps are taken to increase one property of the product, however, other characteristics of the product are often adversely affected.

Tissue products are made via one of two primary tissue manufacturing processes: conventional wet press (CWP) and through-air drying (TAD). In CWP, the tissue is formed on a forming fabric from either a suction breast roll or twin wire former and the embryonic web is transferred to a papermaking felt and dewatered by pressing with one or two pressure roll nips against the surface of a large steam heated cylinder called a Yankee dryer. The pressing process also assists in transfer of the sheet to the Yankee dryer surface. An adhesive solution is sprayed on the dryer surface prior to the sheet transfer in order to provide good bonding between the sheet and the dryer surface. The sheet is removed from the Yankee surface by a doctor blade in the creping process.

In the TAD process, the sheet is formed on a forming fabric and transferred to one or more other fabrics as it is dewatered to a consistency of 25 percent or higher. After the initial dewatering the sheet is dried while in contact with the fabric by blowing hot air through the fabric. In conventional through-air dried processes, the through-air dried web is adhered to a Yankee dryer and creped. A roll may be present at the point of transfer to assist in the transfer of the web from the drying fabric to the Yankee dryer but absent the presence of high pressure used to dewater the web in the CWP process. Alternatively TAD tissue may be prepared without creping where foreshortening of the web occurs with a differential velocity transfer of the wet laid web from the forming fabric to a substantially slower moving, open mesh transfer fabric. Thereafter the web is dried while preventing macroscopic rearrangement of the fibers in the plane of the web. The web is then dried on a fabric in the through-air dryer to a consistency of 90 percent or higher and wound. No Yankee dryer is used in the uncreped through-air dried (UCTAD) process. Through-air dried tissue products are typically associated with higher quality tier tissue products than conventional wet pressed products due to their higher bulk and greater absorption capacity.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually include layered structures where the low coarseness fibers are directed to the outside layer of the tissue sheet with the inner layer of the sheet including longer, coarser fibers.

This need for softness is balanced or perhaps opposed by the need for durability. Durability in tissue products can be defined in terms of tensile strength, tensile energy absorption (TEA), burst strength, and tear strength. Typically tear, burst, and TEA will show a positive correlation with tensile strength while tensile strength, and thus durability, and softness are inversely related. Thus the paper maker is continuously challenged with the need to balance the need for softness with a need for durability. Unfortunately, tissue paper durability generally decreases as the average fiber length is reduced. Therefore, simply reducing the pulp average fiber length can result in an undesirable trade-off between product surface softness and product durability.

The tissue papermaker who is able to obtain pulps having a desirable combination of fiber length and coarseness from fiber blends generally regarded as inferior with respect to average fiber properties may reap significant cost savings and/or product improvements. For example, the papermaker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

Outside of Northern and Southern softwood pulp fibers very few options exist for papermakers when selecting long fibers.

A major problem affecting pulp and paper industries worldwide is the increasing cost of suitable wood fiber resulting from concerns about competing uses for forest lands, environmental impact of forest operations, and sustainable forest management. Consequently, the tissue industry is always searching for alternative low-cost fiber species for sustainable manufacturing. Also, environmental groups and consumers who prefer to use green products have advocated for the use of non-wood fibers as being more environmentally friendly than wood fibers. In order to reduce the reliance on commodity wood pulp, the use of recycled fibers can be a partial solution, but the use of recycled fibers in tissue sheets is technically limited by the end product quality acceptable to users.

Previous approaches rely on tree-based fibers. The ability to use fibrous feedstock that grows in a shorter lifecycle and to use residuals from agricultural or industrial processing can help to fulfill corporate sustainability goals and reduce environmental impact on forests as well as carbon footprint (measured in $eCO_2$ units).

Pulping processes for non-wood natural fibers are raw-material-dependent. Detailed steps can be found in Sridach, W. (2010), The Environmentally Benign Pulping Process of Non-wood Fibers, Suranaree J. Sci. Technol., 17(2), 105-123, and U.S. Pat. No. 6,302,997 B1 to Hurter and Byrd. Alternative non-wood natural fibers such as field crop fibers or agricultural residues are considered more sustainable. Examples of those raw natural materials include miscanthus, soybean stalks, kenaf, flax, bamboo, cotton stalks, sugar cane bagasse, corn stover, rice straw, oat straw, wheat straw, switchgrass, sorghum, reed, *Arundo donax*, other members of the Poaceae family, also known as the Gramineae family, and combinations thereof. Non-wood fiber sources account for about 5-10% of global pulp production, for a variety of reasons, including seasonal availability, problems with chemical recovery, brightness of the pulp, silica content, etc. Particularly attractive are corn stover and wheat straw as sources for pulp due to their global abundance. Non-wood fibers provide an option for product manufacturers to explore to add a green component into their final products.

Therefore, there exists a need for providing wood-alternative pulp materials to replace conventional fiber materials used in tissue. As a result, the present disclosure fills such gaps by providing wood-alternative materials that can be used for environmentally-sustainable tissue.

SUMMARY

Generally, dry paper products, and particularly dry tissue substrates, including a blend of conventional papermaking fibers and non-wood fibers are disclosed herein.

The present disclosure is directed to a tissue sheet including softwood fibers and treated non-wood fibers from plants in the Poaceae family, wherein the treated non-wood fibers have less than 15 percent hemicellulose. The non-wood fibers can be selected from corn stover, straw, other land-based natural fibers, and combinations thereof. The straw can be selected from the group consisting of wheat, rice, oat, barley, rye, flax, grass, soybeans, and combinations thereof. The other land-based natural fibers are selected from flax, bamboo, cotton, jute, hemp, sisal, bagasse, kenaf, switchgrass, miscanthus, and combinations thereof.

The present disclosure is also directed to a tissue sheet consisting essentially of softwood fibers and treated non-wood fibers, wherein the treated non-wood fibers have less than 15 percent hemicellulose.

The present disclosure is also directed to a method for customizing the tensile index and Canadian standard freeness (CSF) of fibers in a tissue sheet, the method including treating non-wood fibers by removing a portion of hemicellulose from the non-wood fibers; forming a tissue sheet comprising softwood fibers and the treated non-wood fibers; and adjusting the portion of hemicellulose removed from the non-wood fibers to achieve a desired the tensile index and Canadian standard freeness (CSF) of the treated non-wood fibers.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
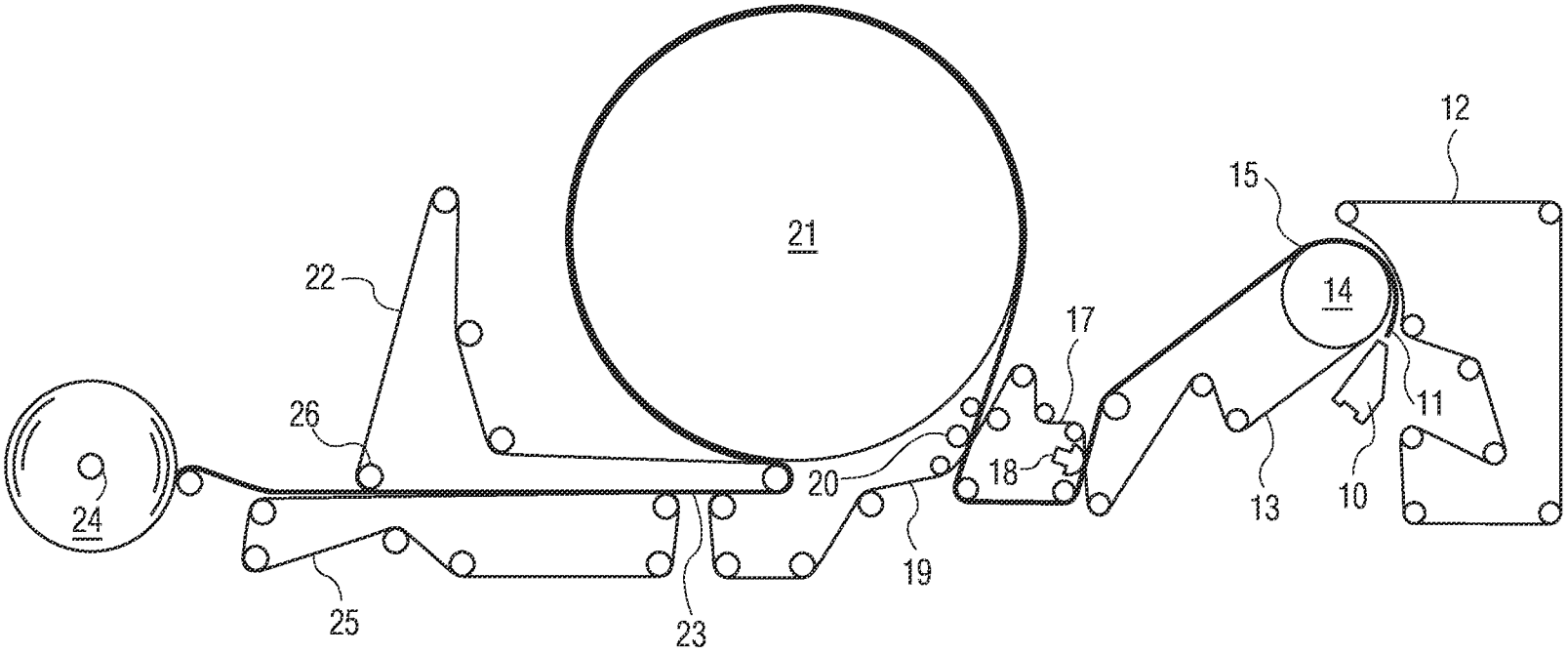
FIG. 1 is a schematic diagram of one aspect of a process for forming an uncreped through-air dried tissue web for use in the present disclosure.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

While the specification concludes with the claims particularly pointing out and distinctly claiming the disclosure, it is believed that the present disclosure will be better understood from the following description.

As used herein, "comprising" means that other steps and other ingredients that do not affect the end result can be added. This term encompasses the terms "consisting of" and "consisting essentially of." The compositions and methods/processes of the present disclosure can comprise, consist of, and consist essentially of the essential elements and limitations of the disclosure described herein, as well as any of the additional or optional ingredients, components, steps, or limitations described herein.

As used herein, the terms "non-wood," "tree-free," and "wood alternative" generally refer to processing residuals from agricultural crops such as wheat straw and wetland non-tree plants such as bulrush. Examples of non-wood natural materials of the present disclosure include, but are not limited to, miscanthus, soybean stalks, kenaf, flax, bamboo, cotton stalks, sugar cane bagasse, corn stover, rice straw, oat straw, wheat straw, switchgrass, sorghum, reed, *Arundo donax*, other members of the Poaceae family, also known as the Gramineae family, and combinations thereof.

As used herein, the term "pulp" or "pulp fiber" refers to fibrous material obtained through conventional pulping processes known in the arts. This can be for woody and non-woody materials.

As used herein, the term "fines" refer to the fraction that passes through a 200 mesh screen (75 μm). The median size of fines is a few microns. Fines consist of cellulose, hemicellulose, lignin, and extractives. There are two types of the fines: primary and secondary fines. The primary fines content seems to be a genetic characteristic of the plant. Eucalyptus pulp is approximately 4%, while other hardwood pulps can be up to about 20% to about 40%. Wheat straw is typically about 38% to about 50%. The secondary fines are pieces of fibrils from the outer layers of fibers that are broken off during refining.

As used herein, the term "basis weight" generally refers to the weight per unit area of paperboard. Basis weight is measured herein using TAPPI test method T-220. A sheet of pulp, commonly 30 cm×30 cm or of another convenient dimension is weighed and then dried to determine the solids content. The area of the sheet is then determined and the ratio of the dried weight to the sheet area is reported as the basis weight in grams per square meter (gsm).

As used herein, the term "Tear Index" refers to the quotient of the geometric mean tear strength (typically expressed in grams) divided by the geometric mean tensile strength (typically expressed in grams per 3 inches) multiplied by 1,000 where the geometric mean tear index is defined as the square root of the product of the machine directional tear strength and the cross directional tear strength.

$$\text{Tear Index} = \frac{\sqrt{MD\ \text{Tear} \times CD\ \text{Tear}}}{GMT} \times 1{,}000$$

While tear index may vary depending on the composition of the tissue web, as well as the basis weight of the web, webs prepared according to the present disclosure generally have a Tear Index greater than about 5, more preferably greater than about 6 and still more preferably greater than about 7 such as from about 7 to about 20.

As used herein, the term "Burst Index" refers to the quotient of the dry burst peak load (also referred to as the dry burst strength and typically expressed gram feet) divided by the geometric mean tensile strength multiplied by 10.

$$\text{Burst Index} = \frac{\text{Dry Burst Strength}}{GMT} \times 10$$

While Burst Index may vary depending on the composition of the tissue web, as well as the basis weight of the web, webs prepared according to the present disclosure generally have a burst index greater than 3, more preferably greater than about 4 and still more preferably greater than about 5.

As used herein, the terms "geometric mean tensile" and "GMT" refer to the square root of the product of the machine direction tensile strength and the cross-machine direction tensile strength of the web. As used herein, tensile strength refers to geometric mean tensile strength as would be apparent to one skilled in the art unless otherwise stated.

As used herein, the terms "geometric mean tensile energy index" and "TEA Index" refer to the square root of the product of the MD and CD tensile energy absorption ("MD TEA" and "CD TEA," typically expressed in g·cm/cm2) divided by the GMT strength multiplied by 1,000.

$$TEA\ \text{Index} = \frac{\sqrt{MD\ TEA \times CD\ TEA}}{GMT} \times 1{,}000$$

While the TEA Index may vary depending on the composition of the tissue web, as well as the basis weight of the web, webs prepared according to the present disclosure generally have a TEA Index greater than about 6, more preferably greater than about 7 and still more preferably greater than about 8, such as from about 8 to about 20.

As used herein, the term "Durability Index" refers to the sum of the tear index, burst index and TEA Index and is an indication of the durability of the product at a given tensile strength.

$$\text{Durability Index} = \text{Tear Index} + \text{Burst Index} + \text{TEA Index}$$

While the Durability Index may vary depending on the composition of the tissue web, as well as the basis weight of the web, webs prepared according to the present disclosure generally have a Durability Index values of about 15 or greater, more preferably about 18 or greater and still more preferably about 20 or greater such as from about 20 to about 50.

As used herein, the term "Stiffness Index" refers to the quotient of the geometric mean tensile slope, defined as the square root of the product of the MD and CD tensile slopes, divided by the geometric mean tensile strength.

$$\text{Stiffness Index} = \frac{\sqrt{MD\ \text{Tensile Slope} \times CD\ \text{Tensile Slope}}}{GMT} \times 1{,}000$$

While the Stiffness Index may vary depending on the composition of the tissue web, as well as the basis weight of the web, webs prepared according to the present disclosure generally have a Stiffness Index values of less than about 16, more preferably less than about 15 and still more preferably less than about 14 such as from about 5 to about 14.

As used herein, the term "average fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i \times n_i)/n$$

where k=maximum fiber length
xi=fiber length
ni=number of fibers having length xi
n=total number of fibers measured.

As used herein, a "tissue product" generally refers to various paper products, such as facial tissue, bath tissue, paper towels, napkins, and the like. Normally, the basis weight of a tissue product of the present disclosure is less than about 80 grams per square meter (gsm), in some aspects less than about 60 gsm, and in some aspects, between about 10 to about 60 gsm.

Tissue products are further differentiated from other paper products in terms of their bulk. The bulk of the tissue and towel products of the present disclosure is calculated as the quotient of the caliper (hereinafter defined), expressed in microns, divided by the basis weight, expressed in grams per square meter. The resulting bulk is expressed as cubic centimeters per gram. In various examples tissue products can have a bulk greater than about 5 cm3/g and still more preferably greater than about 7 cm3/g, such as from about 7 to about 15 cm3/g. Tissue webs prepared according to the present disclosure can have higher bulk than the tissue products incorporating the same webs. For example, tissue webs may have a bulk greater than about 7 cm3/g, such as greater than about 10 cm3/g, such as from about 12 to about 24 cm3/g.

As used herein, the term "layer" refers to a plurality of strata of fibers, chemical treatments, or the like within a ply.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the terms "layered tissue web," "multi-layered tissue web," "multi-layered web," and "multi-layered paper sheet," generally refer to sheets of paper prepared from two or more layers of aqueous papermaking furnish which are preferably included of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "web-forming apparatus" generally includes fourdrinier former, twin wire former, cylinder machine, press former, crescent former, and the like, known to those skilled in the arts.

As used herein the term "Canadian standard freeness" (CSF) refers generally to the rate at which slurry of fibers drains and is measured as described in TAPPI standard test method T 227 OM-09. The unit for the CSF is mL.

Table 1 compares hardwood (eucalyptus pulp fiber, Aracruz Cellulose, Brazil) and softwood (NSWK pulp fiber, Northern Pulp, Canada).

TABLE 1

| Fiber Type | Average Fiber Length (mm) | Average Fiber Width (μm) | Fiber Length:Fiber Width | Coarseness (mg/100 m) |
|---|---|---|---|---|
| NSWK Pulp Fiber | 2.18 | 27.6 | 79 | 14.83 |
| Eucalyptus Pulp Fiber | 0.76 | 19.1 | 40 | 8.95 |

The present disclosure describes the use of non-wood fibers to replace a portion of the virgin wood fiber in at least one of the layers. As described above, however, the tradeoff between softness and strength/durability must be considered. The present disclosure describes how tensile strength can be decreased and softness increased in non-wood fibers by managing the level of hemicellulose in the non-wood fibers. This also increases the Canadian Standard Freeness (CSF) and decreases their Water Retention Value (WRV) and their coarseness. The treated non-wood fibers replace a portion of the eucalyptus fibers in the tissue sheet while increasing durability (increased tear and burst strength) of the tissue sheet.

Typical tissue furnishing includes both long (northern bleached softwood kraft (NBSK)) and short (eucalyptus) fibers. Long fiber provides strength and durability while short fiber provides softness. Comparing agricultural pulp morphology with NBSK and eucalyptus in one example, the length-weighted average fiber length of corn stover (>0.8 mm) and wheat straw (<1 mm) pulps are much shorter than NBSK (2.23 mm) but longer than that of eucalyptus. For this reason, because fiber from corn stover and wheat straw can be used to produce an equivalent softness of eucalyptus, the products made are more durable due to the longer fiber length.

It is commonly observed that non-wood pulps have higher tensile index, lower freeness, and higher water retention value (WRV) than those of wood pulps with similar fiber length. The shorter fiber length of these pulps precludes full replacement of NBSK without a significant quality loss. As a replacement for eucalyptus, many non-wood fibers such as wheat and corn offer advantages over eucalyptus due to their longer fiber length. For example, higher burst and tear strengths would be expected. However, such pulps are generally not suitable for the replacement of eucalyptus due to their high tensile strength which results in lower product softness. While it is possible to use debonders to reduce the tensile strength, the use of debonders significantly increases cost as well as slough and lint in the product. To enable non-wood pulps to replace eucalyptus pulps, there is a need to reduce the tensile index with these non-wood pulps without the use of chemical debonders.

In one aspect, the present disclosure yields soft and durable tissue products including cellulosic fibers from agricultural residues such as corn, switchgrass, and wheat, wherein these cellulosic fibers have had a portion of hemicellulose removed. In another aspect, the present disclosure provides a method of making soft and durable tissue products including cellulosic fibers from agricultural residues, where the method includes replacing all or a portion of short wood fibers in the product with cellulosic fibers from agricultural residues, where the cellulosic fibers from agricultural residues have had all or a portion of hemicellulose removed.

In addition, purpose-grown fiber crops can also be used to provide fiber for the process described herein. These can include miscanthus, switchgrass, soybean stalks, cotton stalks, and the like and can be grown near or with agricultural residue crops such as corn, wheat, soybeans, sorghum, etc. Some of these purpose-grown crops are in the Poaceae family, but others are not yet still provide useful fiber.

Treated non-wood fibers can be selected for use based on fiber length. To replace eucalyptus fibers it can be useful to select fibers having a length weighted average fiber length less than about 1.1 mm such that they are similar to the eucalyptus fibers.

Removing hemicellulose in fibers reduces their tensile index and increases freeness, and is used in dissolving cellulose. The process described herein controls the amount of hemicellulose removed because removing all the hemicellulose such as in dissolving grade cellulose flattens the refining curve and significantly reduces the tensile strength necessary in high-strength applications such as toweling.

In still another aspect the present disclosure provides for tailoring hemicellulose levels to adjust and control tensile index, CSF, and water retention value to improve product softness with non-wood pulps and to improve runability. In yet another aspect the disclosure relates to a method for preparing pulp suitable for tissue making from more than one type of non-wood agricultural residue biomass wherein the level of hemicellulose in the pulps is controlled such that the tensile index and CSF of the resulting unrefined pulps are about equal. This ability to tailor to a tensile index/CSF profile by controlling hemicellulose level enables a biorefinery to run agriculture residuals of various types and purpose-grown biomasses with similar fiber properties throughout the year according to their seasonality and availability. The resulting fibers can have nearly identical properties regardless of fiber source. Because the quality (i.e., tensile index at a given freeness) of such pulps is largely equivalent, the agricultural biorefinery and the tissue-making process can run longer and with less risk of interruption or quality issues than if a single crop is relied upon. Thus there is a need to find a means to control the quality and properties of different fibers such that the freeness and tensile index of the different fibers are equivalent.

Use of alternative non-wood natural fibers such as using field crop fibers and agricultural residues instead of wood fibers is considered more sustainable, due in part to the classification of these materials as by-products of or waste from other processes. Suppliers can pay customers to help them dispose of these materials. Examples of such raw natural materials are bagasse, corn stover, rice straw, oat straw, and wheat straw. Non-wood fiber sources account for only about 5-10% of global pulp production for a variety of reasons including seasonal availability, problems with chemical recovery, brightness of the pulp, silica content, etc.

The present disclosure describes using at least one non-wood or tree-free alternative pulp material in tissue products to replace a portion of conventional fiber materials. The composition of the present disclosure includes at least one non-wood alternative pulp material selected from natural fibers, and combinations thereof. Land-based natural fibers can include flax, cotton stalks, bagasse, kenaf, switchgrass, miscanthus, and combinations thereof. Individual fibrous material from those non-wood materials can be derived from conventional pulping processes such as thermal mechanical pulping, kraft pulping, chemical pulping, enzyme-assisted biological pulping or organosolv pulping known in the art.

The pulp material compositions of the present disclosure can include various amounts of non-wood alternative natural pulp fibers. The composition can have a combination of elements where there is at least one non-wood alternative natural pulp fiber alone or it can be combined with a wood pulp fiber. For example, the amount of non-wood alternative natural pulp fibers of the present disclosure can be present in an amount of from about 5%, from about 10%, from about 20%, from about 25%, from about 30% to about 40%, to about 50%, to about 60%, to about 75%, to about 100% by weight of the composition. The pulp material compositions of the present disclosure can also include a hardwood, short fiber pulp in an amount of from about 5%, from about 10%, from about 20%, or from about 30%, to about 40%, to about 50%, to about 60% or to about 70%, by weight of the composition. When the non-wood alternative pulp materials are present alone, in combination with each other or in combination with a wood pulp fiber, the composition can then be used for a tissue product that replaces a portion of conventional fiber materials.

Accordingly, in a preferred aspect the disclosure provides a tissue web and more preferably a through-air dried tissue web and still more preferably a multi-layered through-air dried web including non-wood fibers, wherein the non-wood fibers include at least about 10 percent of the total weight of the web. In a particularly preferred aspect, the tissue web includes a multi-layered through-air dried web wherein non-wood fiber is selectively disposed in only one of the layers such that the non-wood fiber is not brought into contact with the user's skin in-use. For example, in one aspect the tissue web may include a two layered web wherein the first layer consists essentially of wood fibers and is substantially free of non-wood fibers and the second layer includes non-wood fibers, wherein the non-wood fibers includes at least about 50 percent by weight of the second layer, such as from about 50 to about 100 percent by weight of the second layer. It should be understood that, when referring to a layer that is substantially free of non-wood fibers, negligible amounts of the fibers may be present therein, however, such small amounts often arise from the non-wood fibers applied to an adjacent layer, and do not typically substantially affect the softness or other physical characteristics of the web.

The tissue webs may be incorporated into tissue products that may be either single or multi-ply, where one or more of the plies may be formed by a multi-layered tissue web having non-wood fibers selectively incorporated in one of its layers. A particularly preferred aspect tissue product is constructed such that the non-wood fibers are not brought into contact with the user's skin in-use. For example, the tissue product may include two multi-layered through-air dried webs wherein each web includes a first fibrous layer substantially free from non-wood fibers and a second fibrous layer including non-wood fibers. The webs are plied together such that the outer surface of the tissue product is formed from the first fibrous layers of each web, such that the surface brought into contact with the user's skin in-use is substantially free of non-wood fibers.

Non-wood fiber for use in the webs and products of the present disclosure may be produced by any appropriate methods known in the art. Preferably the non-wood fibers are pulped non-wood fibers, produced by chemical processing of crushed non-wood material. The chemical processing may include treating the crushed non-wood material with an appropriate alkaline solution. The skilled artisan will be capable of selecting an appropriate alkaline solution. Non-wood fiber may also be produced by mechanical processing of crushed non-wood material, which may involve enzymatic digestion of the crushed non-wood material.

Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898 issued Dec. 27, 1988 to Laamanen et al.; U.S. Pat. No. 4,594,130 issued Jun. 10, 1986 to Chang et al.; and U.S. Pat. No. 3,585,104 issued Jun. 15, 1971 to Kleinert. Useful fibers can also be produced by anthraquinone pulping, exemplified by U.S. Pat. No. 5,595,628 issued Jan. 21, 1997 to Gordon et al.

Although non-wood fiber may be produced by any appropriate method known in the art, the preferred method for manufacturing the non-wood pulp is as a chemical pulping method such as, but not limited to, kraft, sulfite, or soda/AQ pulping techniques.

Reducing the level of hemicellulose in non-wood fibers can also be accomplished by any appropriate method known in the art, including the enzymatic process described in U.S. Patent Application Publication No. 2013/0217868 to Fackler et al., although in the present disclosure the removal of hemicellulose must be controlled to avoid degrading cellulose, which is the typical goal of such processes. Enzymes such as those classified as xylanase and/or cellulase can be used although these can degrade cellulose.

In general, the tissue sheet may be formed using any suitable papermaking techniques. For example, a papermaking process can utilize creping, wet creping, double creping, embossing, wet pressing, air pressing, through-air drying, creped through-air drying, uncreped through-air drying, hydroentangling, air laying, as well as other methods known in the art.

One such exemplary technique will be hereinafter described. Desirably, the tissue sheet is a through-air dried tissue basesheet. Exemplary processes to prepare uncreped through-air dried tissue are described in U.S. Pat. Nos. 5,607,551, 5,672,248, 5,593,545, 6,083,346 and 7,056,572, all herein incorporated by reference to the extent they do not conflict herewith.

FIG. 1 illustrates a machine for carrying out the method of forming the multi-layered tissue defined herein. For simplicity, the various tensioning rolls schematically used to define the several fabric runs are shown but not numbered. It will be appreciated that variations from the apparatus and method illustrated in FIG. 1 can be made without departing from the scope of the claims. Shown is a twin wire former having a layered papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Additional dewatering of the wet web can be carried out; such as by vacuum suction, while the wet web is supported by the forming fabric.

The wet web is then transferred from the forming fabric to a transfer fabric 17 traveling at a slower speed than the forming fabric in order to impart increased stretch into the web. Transfer is preferably carried out with the assistance of a vacuum shoe 18 and a fixed gap or space between the forming fabric and the transfer fabric or a kiss transfer to avoid compression of the wet web.

The web is then transferred from the transfer fabric to the through-air drying fabric 19 with the aid of a vacuum transfer roll 20 or a vacuum transfer shoe, optionally again using a fixed gap transfer as previously described. The through-air drying fabric can be traveling at about the same speed or a different speed relative to the transfer fabric. If desired, the through-air drying fabric can be run at a slower speed to further enhance stretch. Transfer is preferably carried out with vacuum assistance to ensure deformation of the sheet to conform to the through-air drying fabric, thus yielding desired bulk and appearance.

The level of vacuum used for the web transfers can be from about 75 to about 380 millimeters of mercury, preferably about 125 millimeters of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the through-air drying fabric, the web is final dried to a consistency of about 94 percent or greater by the through-air dryer 21 and thereafter transferred to a carrier fabric 22. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the first layer of the basesheet.

In certain aspects it may be desirable to have particular combinations of non-wood and wood pulp fibers within a given layer to provide desired characteristics. For example, it may be desirable to combine non-wood and wood fibers having different average fiber lengths, coarseness, cell wall thickness, or other characteristics, in certain layers.

Just as the amount of non-wood within any given layer may be varied, the ratio of non-wood fibers to total fiber in the web may generally vary depending on the desired properties of the tissue product. For instance, the use of a thicker non-wood layer typically results in a tissue product with higher durability but lower softness. Additionally, the use of a large amount of non-wood fibers may negatively impact sheet formation and may increase the cost of manufacture. Likewise, the use of very low amounts of non-wood fibers, i.e., less than about 10 percent of the total weight of the web, typically results in a tissue product having little discernable difference compared to tissue products manufactured without non-wood fibers. Thus, in certain aspects, tissue webs prepared according to the present disclosure include non-wood fibers in an amount from about 10 to about 80 percent by weight of the web, preferably from about from about 15 to about 60 percent, and more preferably from about 25 to about 50 percent. Tissue webs can include more than one type of non-wood fiber as well.

As noted previously, in a preferred aspect non-wood fibers are introduced to the web as a replacement for softwood fibers, accordingly in such preferred aspects the amount of softwood fibers in the web may range from about 0 to about 20 percent by weight of the total web, more preferably from 0 to about 10 percent and most preferably less than about 5 percent by weight of the total web. In one preferred aspect the amount of softwood fiber in the web is less than 1 percent by weight of the total web.

Examples

The following examples further describe and demonstrate aspects within the scope of the present disclosure. The examples are given solely for the purpose of illustration and are not to be construed as limitations of the present disclosure, as many variations thereof are possible. The results indicate tissue can be made including non-wood alternative fibers such as kenaf, wheat straw, miscanthus, corn stover, and bamboo. This disclosure is about tree-free tissue, which is a significant contrast to the current practice that relies on wood pulp.

The present disclosure removes or reduces the hemicellulose content of non-wood fibers to decrease tensile strength of the fibers, thus improving product softness for tissue sheets made from non-wood pulps. Table 2 demonstrates see that the tensile index for wheat straw and corn stover pulp are significantly higher than commercial hardwood eucalyptus pulp when hemicellulose is not removed. The much higher tensile strength will negatively impact tissue softness. Removing more than 50% of the hemicellulose from the corn stover and wheat straw resulted in a significant drop in tensile index. The ability to control hemicellulose composition in non-wood pulps allows for the use of non-wood based pulp derived from agriculture fibers in tissue products without sacrificing product softness.

TABLE 2

| | CSF ml | Tensile Index | WRV |
|---|---|---|---|
| Eucalyptus | 534 | 19.33 | |
| NBSK | 665 | 22.4 | |
| Corn Stover | 316 | 88.8 | 3.68 |
| Corn Stover* | 394 | 45.5 | 3.48 |
| Wheat Straw | 349 | 72 | 2.80 |
| Wheat Straw* | 376 | 47.6 | 2.41 |

*Pulp with partial hemicellulose removal

It should be noted that for most fiber applications, high tensile strength is a positive attribute. In tissue, however, higher tensile strength compromises the softness of the product. This is unique to tissue and not to other paper products. To date most work on use of non-wood fibers has been focused on the broad category of paper rather than the unique needs of tissue.

Figure 2:
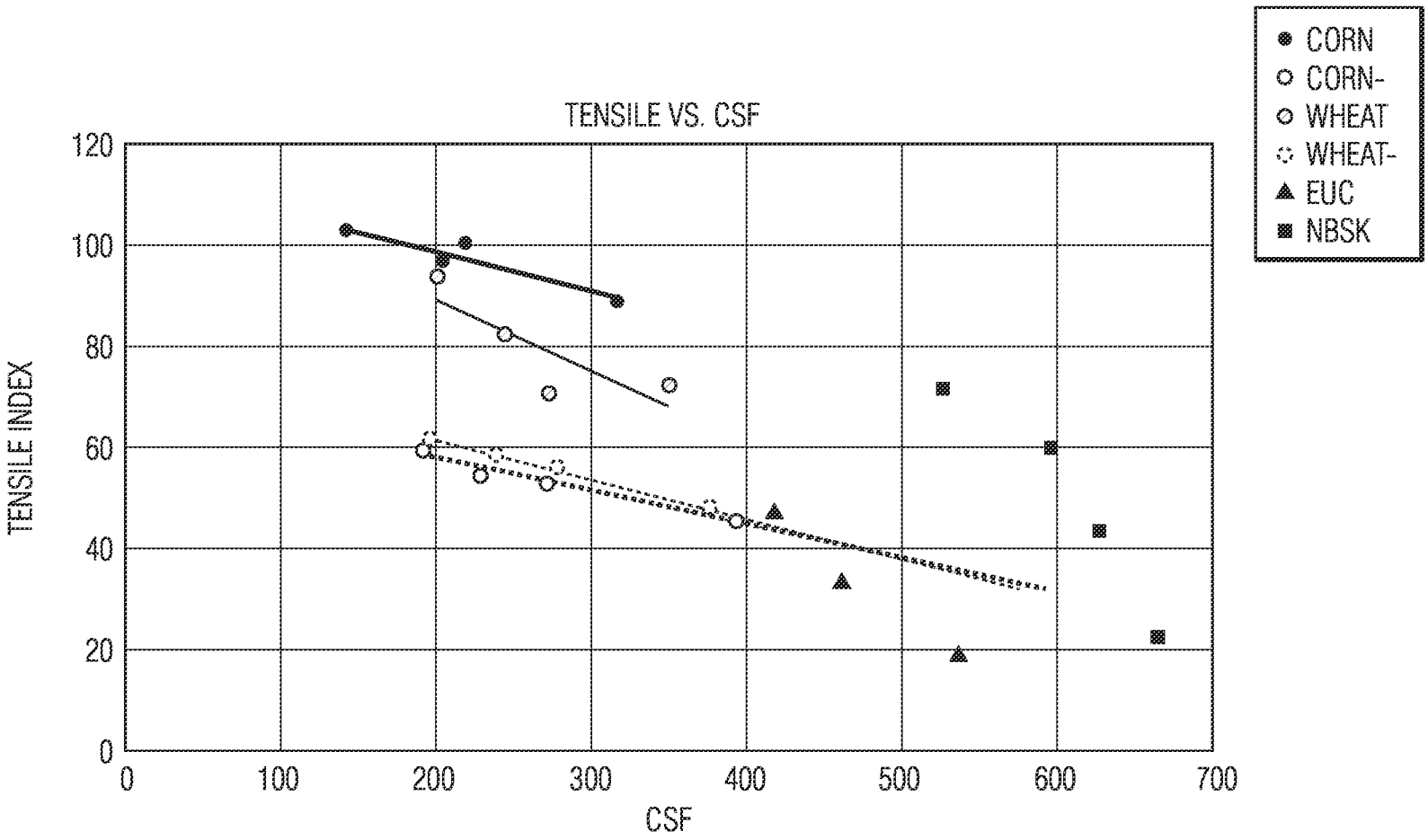
FIG. 2 is a graphical illustration of the relationship between Tensile Index and CSF for various non-wood fibers.

The methods described herein allow one to control the level of hemicellulose in a fiber to reach the desired tensile index/CSF profile. FIG. 2 illustrates the effect of reducing hemicellulose on tensile index and CSF, where the solid dots represent fibers with original levels of hemicellulose and the open dots represent fibers with reduced hemicellulose. Reducing the amount of hemicellulose in a fiber significantly reduces the tensile index of the fiber. This ability to adjust or dial in a tensile index/CSF profile by controlling hemicellulose level enables a biorefinery to run agriculture residuals of various types and purpose-grown biomasses with similar fiber properties throughout the year according to their seasonality and availability. The resulting fibers can have nearly identical properties regardless of fiber source.

In a first particular aspect, a tissue sheet includes softwood fibers and treated non-wood fibers from plants in the Poaceae family, wherein the treated non-wood fibers have less than 15 percent hemicellulose.

A second particular aspect includes the first particular aspect, wherein the non-wood fibers are selected from the group consisting of wheat, corn, miscanthus, bamboo, and combinations thereof.

A third particular aspect includes the first and/or second aspect, further comprising eucalyptus fiber.

A fourth particular aspect includes one or more of aspects 1-3, further comprising hardwood fiber.

A fifth particular aspect includes one or more of aspects 1-4, comprising two outer layers and at least one inner layer.

A sixth particular aspect includes one or more of aspects 1-5, wherein an outer layer comprises hardwood fibers and non-wood fibers and the at least one inner layer comprises softwood fibers.

A seventh particular aspect includes one or more of aspects 1-6, wherein the at least one inner layer comprises hardwood fibers and non-wood fibers.

An eighth particular aspect includes one or more of aspects 1-7, wherein the two outer layers comprise hardwood fibers.

A ninth particular aspect includes one or more of aspects 1-8, wherein the treated non-wood fibers have at least 50 percent less hemicellulose than the same non-wood fibers without treatment.

A tenth particular aspect includes one or more of aspects 1-9, wherein the treated non-wood fibers have at least 70 percent less hemicellulose than the same non-wood fibers without treatment.

An eleventh particular aspect includes one or more of aspects 1-10, wherein the tissue sheet is softer and more durable than a tissue sheet comprising softwood fiber and eucalyptus fiber in the place of the treated non-wood fiber.

A twelfth particular aspect includes one or more of aspects 1-11, wherein the treated non-wood fiber has a higher CSF and a lower WRV than eucalyptus fiber.

In a thirteenth particular aspect, a tissue sheet consists essentially of softwood fibers and treated non-wood fibers, wherein the treated non-wood fibers have less than 15 percent hemicellulose.

A fourteenth particular aspect include the thirteenth particular aspects, wherein the treated non-wood fibers have at least 30 percent less hemicellulose than the same non-wood fibers without treatment.

A fifteenth particular aspect includes the thirteenth and/or fourteenth particular aspects, wherein the treated non-wood fibers have at least 50 percent less hemicellulose than the same non-wood fibers without treatment.

In a sixteenth particular aspect, a method for customizing the tensile index and Canadian standard freeness (CSF) of fibers in a tissue sheet includes treating non-wood fibers by removing a portion of hemicellulose from the non-wood fibers; forming a tissue sheet comprising softwood fibers and the treated non-wood fibers; and adjusting the portion of hemicellulose removed from the non-wood fibers to achieve a desired the tensile index and Canadian standard freeness (CSF) of the treated non-wood fibers.

A seventeenth particular aspect includes the sixteenth particular aspect, the tissue sheet further comprising eucalyptus fiber.

An eighteenth particular aspect includes the sixteenth and/or seventeenth particular aspects, the tissue sheet further comprising hardwood fiber.

A nineteenth particular aspect includes one or more of aspects 16-18, wherein the non-wood fibers are selected from plants in the Poaceae family including wheat, corn, miscanthus, and bamboo.

A twentieth particular aspect, includes one or more of aspects 16-19, wherein the treated non-wood fibers have less than 15 percent hemicellulose.

All percentages, parts and ratios are based upon the total weight of the compositions of the present disclosure, unless otherwise specified. All such weights as they pertain to listed ingredients are based on the active level and, therefore; do not include solvents or by-products that can be included in commercially available materials, unless otherwise specified. The term "weight percent" can be denoted as "wt. %" herein. Except where specific examples of actual measured values are presented, numerical values referred to herein should be considered to be qualified by the word "about."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description are, in relevant part, incorporated herein by reference; the citation of any document is not to be construed as an admission that it is prior art with respect to the present disclosure. To the extent that any meaning or definition of a term in this written document conflicts with any meaning or definition of the term in a document incorporated by reference, the meaning or definition assigned to the term in this written document shall govern.

While particular aspects of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A method of manufacturing a tissue sheet comprising the steps of:

dispersing a plurality of softwood fibers in water to form a first fiber slurry;

treating a plurality of non-wood fibers derived from one or more plants in the Poaceae family with a hemicellulose enzyme to yield treated non-wood fibers having less than 15 percent hemicellulose and a Canadian Standard Freeness (CSF) greater than about 350 ml;

dispersing the treated non-wood fibers to form a second fiber slurry;

dispersing the first and second fiber slurries onto a forming fabric to form a wet tissue web;

dewatering the wet tissue web to form a partially dewatered tissue web; and drying the partially dewatered tissue web to form a dried tissue web.

2. The method of claim 1, wherein the non-wood fibers are derived from the group consisting of wheat, corn, miscanthus, bamboo, and combinations thereof.

3. The method of claim 1, further comprising the steps of dispersing a plurality of eucalyptus fibers to form a third fiber furnish slurry and dispersing the third fiber furnish onto a forming fabric with the first and second fiber furnishes to form a wet tissue web.

4. The method of claim 1, further comprising the steps of dispersing a plurality of hardwood fibers to form a third fiber furnish slurry and dispersing the third fiber furnish onto a forming fabric with the first and second fiber furnishes to form a wet tissue web.

5. The method of claim 1, wherein the first and second fiber slurries are dispersed onto the forming fabric in layers to form a wet tissue web having two outer layers and at least one inner layer.

6. The method of claim 5, wherein an outer layer comprises treated non-wood fibers and the at least one inner layer comprises softwood fibers.

7. The method of claim 5, wherein the at least one inner layer comprises treated non-wood fibers.

8. The method of claim 1, wherein the treated non-wood fibers have at least 50 percent less hemicellulose than the same non-wood fibers without treatment.

9. The method of claim 1, wherein the treated non-wood fibers have at least 70 percent less hemicellulose than the same non-wood fibers without treatment.

10. The method of claim 1, wherein the dried tissue web has a lower tensile index compared to a tissue sheet comprising softwood fiber and eucalyptus fiber in the place of the treated non-wood fiber.

11. The method of claim 1, wherein the treated non-wood fiber has a Water Retention Value (WRV) less than about 3.5.

* * * * *